US008214967B2

(12) United States Patent
Knox et al.

(10) Patent No.: US 8,214,967 B2
(45) Date of Patent: Jul. 10, 2012

(54) FLOOR TOOL

(75) Inventors: Alexander Stuart Knox, Malmesbury (GB); Tan Yeou Ren, Johor Bahru (MY); Sai Her Bong, Johor Bahru (MY)

(73) Assignee: Dyson Technology Limited, Malmesbury (GB)

( * ) Notice: Subject to any disclaimer, the term of this patent is extended or adjusted under 35 U.S.C. 154(b) by 257 days.

(21) Appl. No.: 12/709,252

(22) Filed: Feb. 19, 2010

(65) Prior Publication Data

US 2010/0223753 A1 Sep. 9, 2010

(30) Foreign Application Priority Data

Mar. 3, 2009 (GB) ..... 0903588.2

(51) Int. Cl.
*A47L 9/02* (2006.01)

(52) U.S. Cl. ..... 15/363; 15/415.1; 15/422.1

(58) Field of Classification Search ..... 15/363, 15/422, 422.1, 420, 359, 368, 375, 378, 387, 15/391
See application file for complete search history.

(56) References Cited

U.S. PATENT DOCUMENTS

| | | | | |
|---|---|---|---|---|
| 1,050,989 | A * | 1/1913 | Niuffer | 15/415.1 |
| 2,880,446 | A * | 4/1959 | Muller | 15/373 |
| 4,336,628 | A * | 6/1982 | Bradshaw et al. | 15/415.1 |
| 7,526,834 | B2 * | 5/2009 | Coleman | 15/387 |

FOREIGN PATENT DOCUMENTS

| | | |
|---|---|---|
| EP | 0304609 | 3/1989 |
| EP | 0353546 | 2/1990 |
| JP | 54-114353 | 8/1979 |
| JP | 54-155653 | 12/1979 |
| JP | 60-63145 | 5/1985 |
| WO | WO-03/039315 | 5/2003 |

OTHER PUBLICATIONS

GB Search Report dated May 14, 2009, directed at counterpart GB Application No. GB0903588.2; 1 page.

Third-party communication with annexes, dated Apr. 12, 2012, directed to EP patent application No. 2 225 991; 8 pages.

* cited by examiner

*Primary Examiner* — Dung Van Nguyen

(74) *Attorney, Agent, or Firm* — Morrison & Foerster LLP

(57) ABSTRACT

The present invention relates to a floor tool for a surface treating appliance including, a sole plate comprising a floor engaging surface having forward and rearward floor contacting edges and a suction opening, a head which is pivotable relative to the sole plate about an articulation axis between forward and rearward positions, the head having a front sole plate engaging edge and a back sole plate engaging edge, and a connecting arm comprising an outlet in communication with the suction opening, at least a portion of the floor engaging surface of the sole plate extends beyond the back sole plate engaging edge of the head when the head is in the rearward position.

23 Claims, 5 Drawing Sheets

FLOOR TOOL

REFERENCE TO RELATED APPLICATIONS

This application claims priority of United Kingdom Application No. 0903588.2 filed Mar. 3, 2009, the entire contents of which are incorporated herein by reference.

FIELD OF THE INVENTION

This invention relates to a floor tool for a surface treating appliance. Particularly, but not exclusively, the invention relates to a floor tool for a vacuum cleaner.

BACKGROUND OF THE INVENTION

A wide range of vacuum cleaners are available on the market and include upright cleaners, stick vac cleaners, cylinder cleaners and hand-held cleaners. A cylinder vacuum cleaner normally has a main body containing a motor and fan assembly for drawing an airflow into the main body and separating apparatus for separating dirt and dust from the airflow. The separating apparatus may take the form of, for example, a cyclonic separator, a bag or a filter. A hose and wand assembly is connected to the main body and a floor tool is attached to the end of the wand remote from the main body so that it can be maneuvered across the surface to be cleaned. A range of floor tools are often supplied so that a user can choose an appropriate tool for their cleaning task; for example a crevice tool or a brush tool.

Many upright vacuum cleaners are provided with releasable hoses or wands so that they are able to operate in the manner of a cylinder machine. Floor tools are thus often provided with upright machines as well.

Handheld vacuum cleaners are provided with a nozzle which may be rigid or flexible. A range of floor tools may be supplied so that a user can choose an appropriate tool for their cleaning task.

Floor tools generally comprise a head having a lower surface, commonly known as a soleplate. A suction opening is formed in the soleplate through which, in use, dirt and dust is drawn into the floor tool from the floor surface. It is useful for the head to be pivotally connected to the sole plate so that the head or the soleplate can rock back and forth as the floor tool is pushed and pulled across the floor surface. The rocking motion allows the suction opening to remain in close proximity to the floor surface when the floor tool is pushed or pulled across the floor surface. The rocking motion is particularly advantageous on carpeted surfaces because it can cause parts of the soleplate to agitate the carpet.

Although agitation is desirable in most instances, a problem can arise with such floor tools, namely that as the floor tool is pulled backwards along a floor surface the rearward floor contacting edge of the sole plate can act as a pivot point against the floor. In some circumstances the cleaner head will pivot about this rearward floor contacting edge causing the cleaner head to "skip" backwards. This problem can be more apparent on long pile carpets because as the floor tool starts to pivot about the pivot point the rearward floor contacting edge of the sole plate can dig into the carpet pile causing more skipping. A solution to this problem is therefore desirable.

Existing arrangements illustrating floor tools which attempt to deal with this problem are shown in EP 0353546, EP 0304609 and WO 03/039315.

EP 0353546 discloses a floor tool which has a set of floor-engaging wheels and a soleplate. The duct connecting the head to the wand has a pivot point located directly above the axis of the wheels so that, when a user pushes forward on the wand, a downwardly-acting moment about the axis of the wheels pushes the soleplate onto the floor surface. EP 0304609 discloses a floor tool having a complicated arrangement of pivots which forces the head of the floor tool to rock back and forth when the floor tool is pushed back and forth across a floor surface. WO 03/039315 discloses a floor tool having a connecting duct which is pivoted in two locations relative to the soleplate.

In order to operate effectively, the above arrangements all require complicated and therefore expensive pivot point arrangements. Consequently, a more simple solution to the problem of skipping would be desirable.

SUMMARY OF THE INVENTION

Accordingly the present invention provides a floor tool for a surface treating appliance comprising,

- a sole plate comprising a floor engaging surface having forward and rearward floor contacting edges and a suction opening,
- a head which is pivotable relative to the sole plate about an articulation axis between forward and rearward positions, the head having a front sole plate engaging edge and a back sole plate engaging edge, and
- a connecting arm comprising an outlet in communication with the suction opening,
- wherein at least a portion of the floor engaging surface of the sole plate extends beyond the back sole plate engaging edge of the head when the head is in the rearward position.

In the present invention the pivot point about which the floor tool may pivot and thus "skip" against a floor surface is a rear edge of the portion and/or the rearward floor contacting edge of the sole plate. The present invention is advantageous because it extends the distance between the articulation axis and the pivot point of the floor tool. Increasing the distance between the articulation axis and the pivot point by extending at least a portion of the floor engaging surface of the sole plate beyond the back sole plate engaging edge of the head has been found to make it much harder to pivot the floor tool during normal use thus helping to reduce skipping.

In a preferred embodiment the portion extends beyond the back sole plate engaging edge of the head along the entire or substantially the entire length of the soleplate. In this embodiment the portion is essentially an extension of the floor engaging surface 36 of the sole plate, such that the rearward floor contacting edge is located beyond the back sole plate engaging edge of the head. In this embodiment the pivot point is the rearward floor contacting edge of the sole plate. The portion may be of any suitable length or shape as long as it extends beyond the back sole plate engaging edge of the head to increase the length of the floor engaging surface and thus increase the distance between the articulation axis and the pivot pint.

Alternatively, the floor tool may comprise a plurality of portions. Again the portions may be of any suitable shape as long as at least one portion extends beyond the back sole plate engaging edge of the head to increase the length of at least a portion of the floor engaging surface and thus increase the distance between the articulation axis and the pivot pint. As an example, in cross section, one or more portions may be tear shaped, square, rectangular or triangular in shape. The floor engaging surface of the portion(s) may also be of any suitable shape for example square, rectangular or triangular.

In a preferred embodiment the floor tool may comprise a single portion which extends beyond the back sole plate engaging edge of the head at a location spaced from side edges of the sole plate. For example the portion may be located centrally or substantially centrally. In a preferred embodiment the portion may be located in line with the outlet of the floor tool.

The portion may extend at least 10 mm, or 12 mm, or 14 mm, or 16 mm, or 18 mm, or 20 mm, or 22 mm, or 24 mm, or 26 mm beyond the back sole plate engaging edge of the head and/or beyond the rearward floor contacting edge of the sole plate. It is desirable that the portion is as long as possible.

In a preferred embodiment the portion or a pivot point of the portion may extend from 30 mm, or 35 mm, or 40 mm, or 45 mm, or 50 mm, to 55 mm or 60 mm, or 65 mm, or 70 mm, or 100 mm from the articulation axis. In a particularly preferred embodiment the portion may extend from 50 mm to 55 mm, for example 53.4 mm from the articulation axis The portion may be of any suitable width and depth. The width may be from 2 mm, or 10 mm, or 15 mm, or 20 mm, or 25 mm, or 30 mm, or 35 mm, or 40 mm, or 45 mm, to 50 mm, or 55 mm, or 60 mm, or 65 mm, or 70 mm, or 75, or 80 mm or the entire length of the sole plate.

The depth may be from 1 mm, or 2 mm, or 3 mm, or 4 mm, or 5 mm deep. In a particular embodiment the portion may be the same depth as the remainder of the sole plate.

The sole plate may further comprise a front lip which may extend from at least a part of the forward floor contacting edge of the soleplate. Ideally a front lip may extend from the entire or substantially the entire length of the forward floor contacting edge of the soleplate. In a preferred embodiment the front lip may curve upwardly, for example upwardly and away from the forward floor contacting edge of the soleplate.

The sole plate may also further comprise a rear lip which may extend from at least a part of the rearward floor contacting edge of the soleplate. Ideally a rear lip may extend from the entire or substantially the entire length of the soleplate. In some embodiments the rear lip may be split into separate sections because the portion or portions may split the rearward floor contacting edge.

In a preferred embodiment the rear lip or one or more sections of the rear lip may curve upwardly, for example upwardly and away from the rear floor contacting edge of the soleplate. It is also possible that at least a section of the rear lip may be larger than at least another section of the rear lip and/or a section of the front lip. For example, in an embodiment where the portion is an extension of the floor engaging surface of the sole plate i.e. where the floor engaging surface of the sole plate extends beyond the back sole plate engaging edge of the head, a relatively larger rear lip may extend from the rearward floor contacting edge of the soleplate and a relatively smaller lip may extend from the forward floor contacting edge of the soleplate. Such lips may help to prevent the sole plate "digging in" to a carpet during use of the cleaning appliance.

In a particular embodiment the rear lip along a part of its length or all of its length may be associated with the portion, for example the pivot point of the portion may be connected to the lip in some manner. Thus the portion may be in the form of a loop or a solid shape such that at least a part of the portion and at least a part of the rear lip, for example the pivot point and the rear edge of the rear lip may be connected.

According to a second aspect of the present invention there is provided a surface treating appliance including a floor tool as described above. In a preferred embodiment the surface treating appliance may be in the form of a cyclonic vacuum cleaner. The surface treating appliance may be a handheld vacuum cleaner. Other aspects of the second aspect may be as described in relation to the first aspect.

The term "surface treating appliance" is intended to have a broad meaning, and includes a wide range of machines having a floor tool for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines and shampooing machines.

BRIEF DESCRIPTION OF THE DRAWINGS

Embodiments of the invention will now be described with reference to the accompanying drawings, in which.

DETAILED DESCRIPTION OF THE INVENTION

Figure 1:
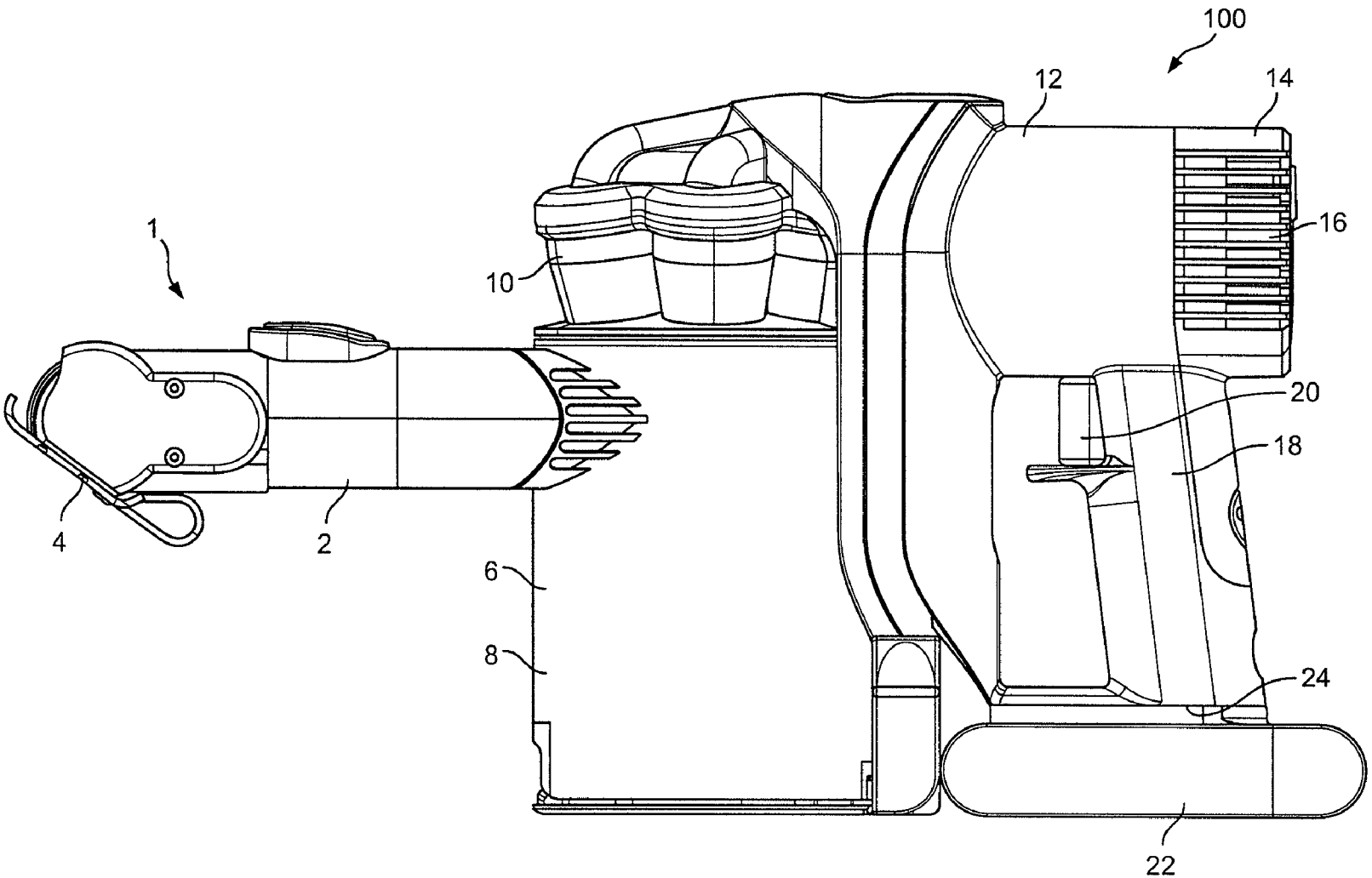
FIG. 1 shows a view of a floor tool according to the present invention attached to a handheld vacuum cleaner.
Figure 2:
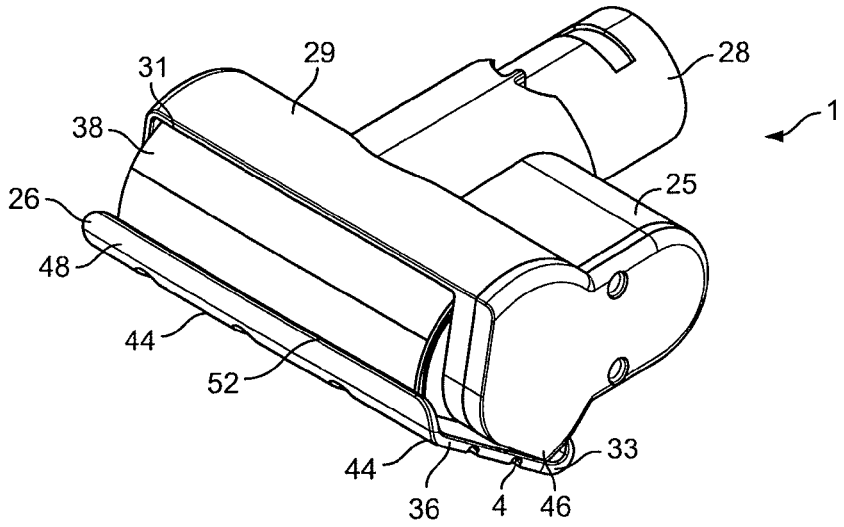
FIG. 2 is a front perspective view of a first embodiment of a floor tool according to the present invention.

FIG. 1 shows a hand-held vacuum cleaner 100. The hand-held vacuum cleaner 100 comprises a suction conduit 2 having a suction opening 4 in an attached floor tool 1. The vacuum cleaner 100 also includes cyclonic separating apparatus 6 for separating dirt and dust from an airflow drawn in through the suction opening 4. The cyclonic separating apparatus 6 is in communication with the suction conduit 2 and the suction opening 4. The cyclonic separating apparatus 6 comprises an upstream cyclone 8 and a plurality of downstream cyclones 10.

The vacuum cleaner 100 further includes a motor housing 12 and a removable casing 14 having a plurality of exhaust vents 16 formed therein. An air flow path extends from the suction opening 4, through the suction conduit 2, the cyclonic separating apparatus 6 and the motor housing 12 to the exhaust vents 16. A handgrip 18 is located below the motor housing 12 for manipulating the hand-held vacuum cleaner 100 when in use. The handgrip 18 is arranged so that the cyclonic separating apparatus 6 is located between the handgrip 18 and the suction opening 4. The handgrip 18 includes a trigger switch 20 which is positioned on the side of the handgrip 18 closest to the suction opening 4 such that the trigger switch 20 can be manipulated by a user's index finger. A power source 22 in the form of a lithium ion battery pack is connected to the handgrip 18 through a mounting portion 24.

When operating, an airflow generator (not shown) draws a flow of dirt- and dust-laden air into the suction opening 4 of the floor tool 1, through the suction conduit 2 and into the cyclonic separating apparatus 6. The cleaned air exits the cyclonic separating apparatus 6 and passes sequentially through a pre-motor filter if present and the airflow generator before being exhausted through the exhaust vents 16.

In order to clean a floor, the user grips the handle 18 and maneuvers the floor tool 1 across the floor surface.

FIGS. 2 to 7 show a first embodiment of the floor tool 1 in greater detail. It can be seen that the floor tool 1 includes a head 25, a sole plate 26 and a connecting arm 28. The connecting arm 28 is rigidly attached to the head 25, although it is possible that it could be pivotally connected to the head 25 if desired. The sole plate 26 is pivotally connected to the head 25 about an articulation axis A (shown in FIGS. 3 and 6).

The head 25 includes a barrel shaped body 29 in which a brush bar 30 is located. The brush bar 30 is rotatable about the same axis A that the sole plate 26 is rotatable about. The brush bar 30 may be of any suitable construction and may be either motor or turbine driven.

The soleplate 26 faces a floor surface in use and includes a suction opening 4. The suction opening 4 is in the form of a plurality of apertures 34 defined by a floor engaging surface 36 of the sole plate 26. It can also be seen that the sole plate 26 further comprises upstanding front and rear walls (only the front wall 38 can be seen) which correspond in shape to the inner surface of the barrel shaped body 29 of the head 25. These walls 38 ensure that as the head 25 rotates about the articulation axis A, a substantially airtight pathway is always provided between the suction opening 4 and the outlet 42 of the connecting arm 28.

The head 25 further comprises a front sole plate engaging edge 31 and a back sole plate engaging edge 33. The front sole plate engaging edge 31 comes into contact with the sole plate 26 when the head 25 is in its forward position. The back sole plate engaging edge 33 comes into contact with the sole plate 26 when the head 25 is in the rearward position. This rearward position can be seen in FIGS. 2 to 6.

The floor engaging surface 36 of the sole plate 26 has forward and rearward floor contacting edges 44, 46. The sole plate 26 also further comprises and a front and rear lip 48, 50. The front and rear lips 48, 50 have front and rear edges 52, 54 respectively. It can be seen that the front lip 48 curves upwardly from the forward floor contacting edge 44 of the soleplate 26 and the rear lip 50 curves upwardly from the rearward floor contacting edge 46 of the sole plate 26.

Figure 3:
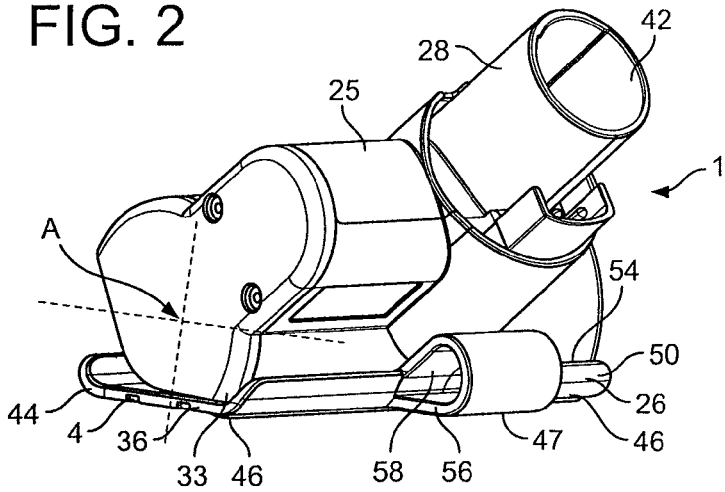
FIG. 3 is a rear perspective view of the floor tool shown in FIG. 2.
Figure 4:
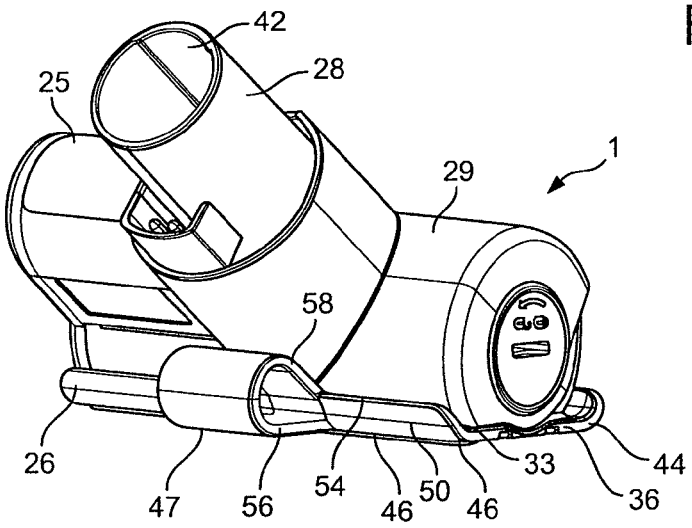
FIG. 4 is a rear perspective view of the floor tool shown in FIGS. 2 and 3, FIGS. 5 and 6 are side views of the floor tool shown in FIGS. 2 to 4.
Figure 5:
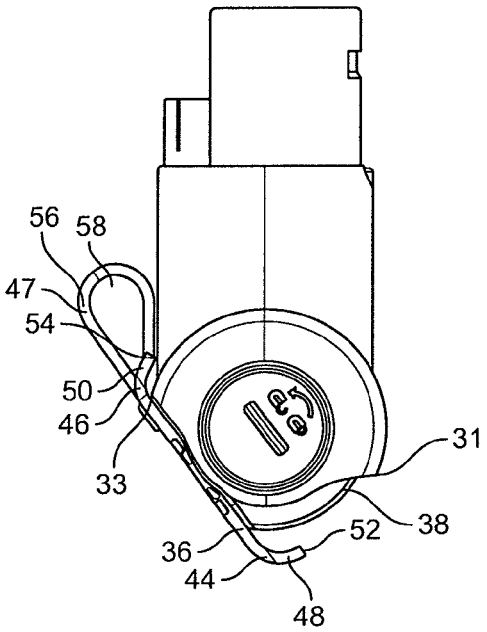
Figure 6:
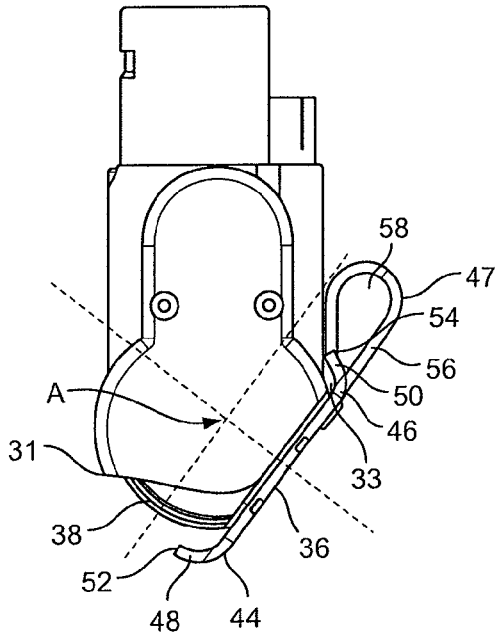
Figure 7:
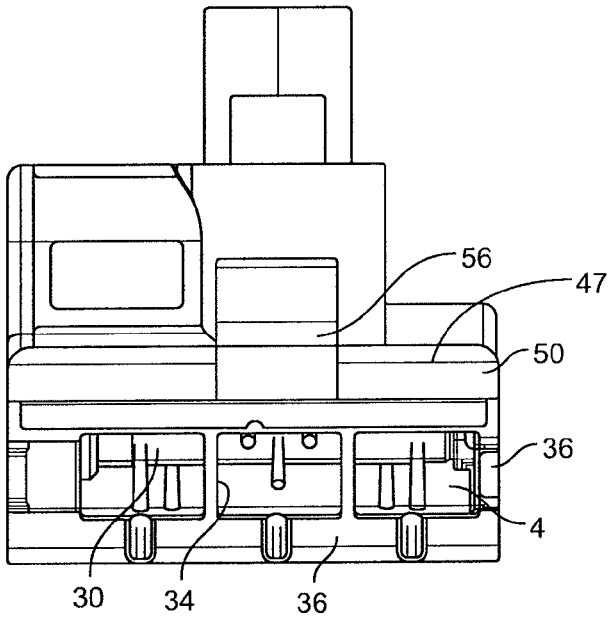
FIG. 7 is an underside view of the floor tool shown in FIGS. 2 to 6.

In FIGS. 3 and 4 a portion 56 can be seen to extend from the rearward floor contacting edge 46 of the sole plate 26 beyond the back sole plate engaging edge 33 of the head 25 when the head 25 is in the rearward position. This extends the distance between the articulation axis A and the pivot point 47 which is located at the back edge of the portion 56. Increasing this distance makes it much harder to pivot the whole floor tool 1 during normal use thus helping to reduce skipping. Without the portion 56 the floor tool 1 would pivot about the rearward floor contacting edge 46 of the sole plate 26 which would occur much more readily during normal use of the vacuum cleaner 100.

In the embodiment shown in FIGS. 2 to 7 it can be seen that there is a single portion 56. It is of course possible to have a plurality of such portions 56. Such a portion 56 or portions may be located at any suitable position along the length of the rearward floor contacting edge 46 of the sole plate 26. In FIGS. 3 to 6 it can be seen that the portion 56 curves upwardly to form a loop 58. It can be seen in FIGS. 3 and 4 that the loop 58 connects a portion of the rear edge 54 of the rear lip 50 with the pivot point 47 at the rear edge of the portion 56.

The shape of the portion 56 is not important, the important feature is that the distance between the pivot point 47 of the floor tool 1 and the axis A is as large as possible. The loop 58 could therefore be solid and the edges could be angled rather than curved as long as there is a flat surface which lies in the same plane as the floor engaging surface 36 of the sole plate 26 and which extends rearwardly beyond the back sole plate engaging edge 33 of the head 25 when the head 25 is in the rearward position. For example the portion 56 could be planar, cuboidal, pyramidal or any other suitable shape.

Figure 8:
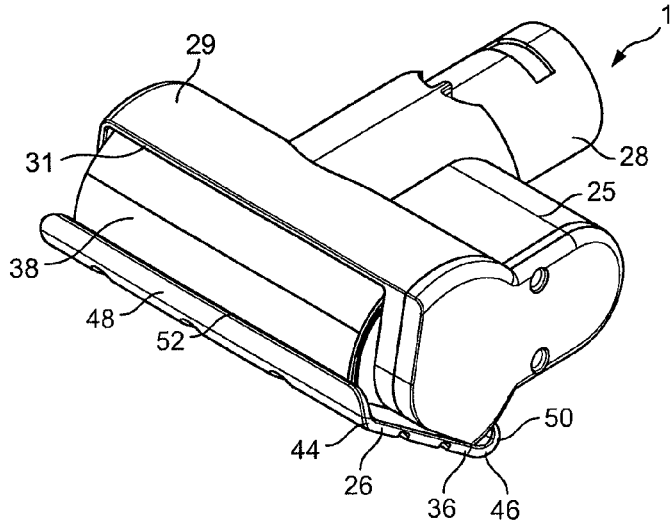
FIG. 8 is a front perspective view of a second embodiment of a floor tool according to the present invention.
Figure 9:
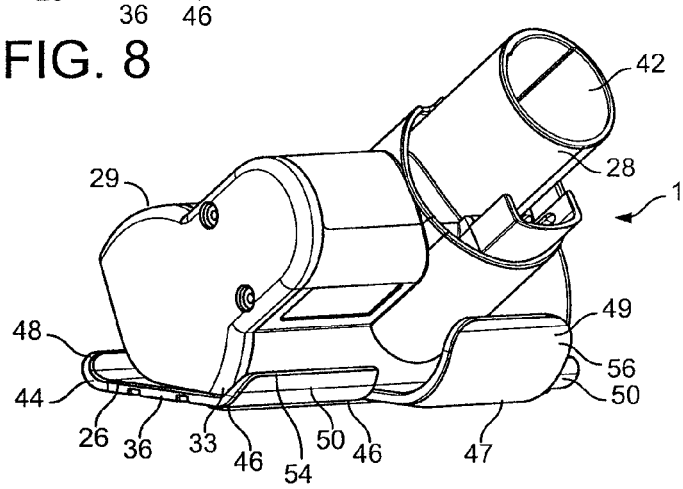
FIG. 9 is a rear perspective view of the floor tool shown in FIG. 8.
Figure 10:
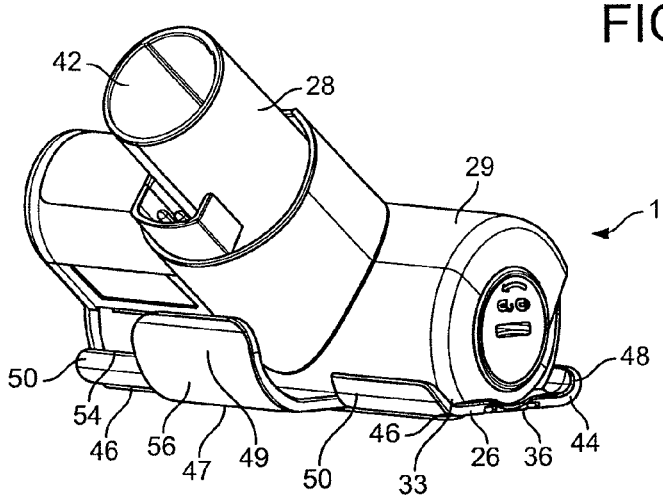
FIG. 10 is a rear perspective view of the floor tool shown in FIGS. 8 and 9.

In the second embodiment shown in FIGS. 8 to 10 there is a single portion 56. In this embodiment the portion 56 has a free end. In other words the portion 56 is not connected to a portion of the rear edge 54 of the rear lip 50 as in the first embodiment. In this second embodiment the portion 56 extends rearwardly in the same plane as the floor contacting surface 36 of the sole plate 26 for a distance beyond the back sole plate engaging edge 33 of the head 25 when the head 25 is in the rearward position. The portion 56 then curves upwardly. In the embodiment shown the curved portion 49 on portion 56 is larger than the rear lip 50 which extends from the rearward floor contacting edge 46 of the sole plate 26 on either side of the portion 56. Again the exact shape of the portion 56 is not important, the important feature is that the distance between the pivot point 47 of the floor tool 1 and the axis A is as large as possible.

Figure 11:
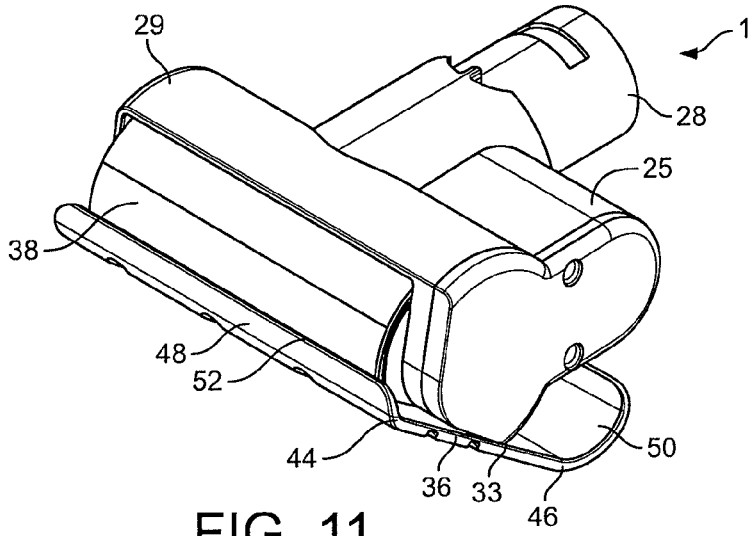
FIG. 11 is a front perspective view of a third embodiment of a floor tool according to the present invention.
Figure 12:
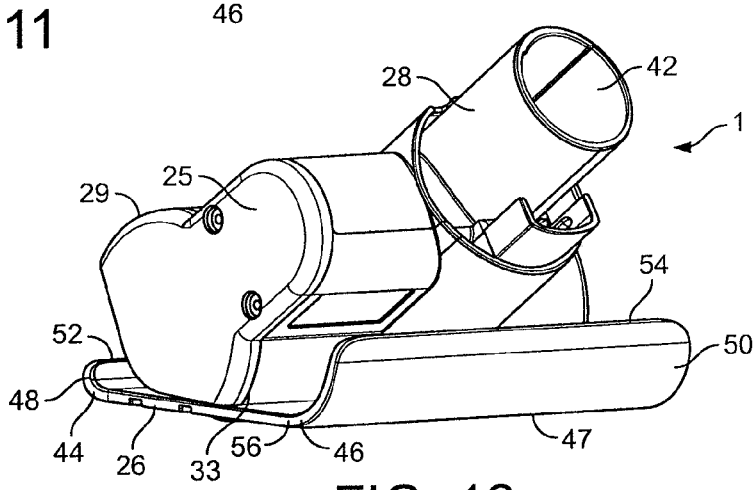
FIG. 12 is a rear perspective view of the floor tool shown in FIG. 11.
Figure 13:
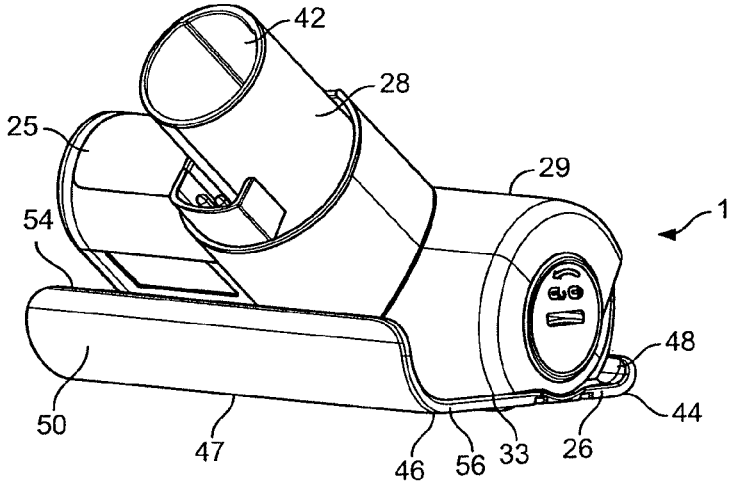
FIG. 13 is a rear perspective view of the floor tool shown in FIGS. 10 and 11.

In the third embodiment shown in FIGS. 11 to 13 the portion 56 is an extension of the floor engaging surface 36 of the soleplate 26 along its entire length. Again this portion extends rearwardly in the same plane as the floor contacting surface 36 of the sole plate 26 for a distance beyond the back sole plate engaging edge 33 of the head 25 and then a rear lip 50 curves upwardly.

In FIGS. 11 to 13 it can be seen that the rear lip 50 is larger than the front lip 48. In an alternative embodiment the rear lip 50 may be the same size or smaller than the front lip 48. In another alternative embodiment there may only be one lip 48, 50 or no lips. Again the exact shape of the portion 56 is not important, the important feature is that the distance between the pivot point 47 of the floor tool 1 and the axis A is as large as possible. In this embodiment the pivot point 47 is also the rearward floor contacting edge 46 of the sole plate 26.

The invention claimed is:

1. A floor tool for a surface treating appliance comprising, a sole plate comprising a floor engaging surface having a forward floor contacting edge and a rearward floor contacting edge and a suction opening, a head which is pivotable relative to the sole plate about an articulation axis between forward and rearward positions, the head having a front sole plate engaging edge and a back sole plate engaging edge, and a connecting arm comprising an outlet in communication with the suction opening, wherein the forward floor contacting edge of the sole plate extends in a direction forward from the articulation axis by a first distance, and wherein at least a portion of the rear floor contacting edge of the sole plate extends beyond the back sole plate engaging edge of the head, when the head is in the rearward position, in a direction rearwards from the articulation axis by a second distance which is greater than the first distance.

2. A floor tool according to claim 1 wherein the portion extends beyond the back edge of the head along the entire or substantially the entire length of the soleplate.

3. A floor tool according to claim 1 comprising a plurality of portions.

4. A floor tool according to claim 1 comprising a single portion which extends beyond the back sole plate engaging edge of the head at a location spaced from side edges of the sole plate.

5. A floor tool according to claim 1 wherein the portion extends from 50 mm to 55 mm from the articulation axis.

6. A floor tool according to claim 1 wherein the sole plate further comprises a front lip which extends from at least a part of the forward floor contacting edge of the soleplate.

7. A floor tool according to claim 6 wherein at least a part of the lip curves upwardly.

8. A floor tool according to claim 1 wherein the sole plate further comprises a rear lip which extends from at least a part of the rearward floor contacting edge of the soleplate.

9. A floor tool according to claim 8 wherein at least a part of the lip curves upwardly.

10. A floor tool according to claim 8 wherein at least a part of the rear lip is associated with the portion which extends beyond the back sole plate engaging edge of the head to form a loop.

11. A tool according to claim 1 wherein the sole plate further comprises a front lip which extends from at least a part of the forward floor contacting edge of the soleplate and a rear lip which extends from at least a part of the rearward floor contacting edge of the soleplate.

12. A floor tool according to claim 11 wherein at least a part of the rear lip is larger than at least a part of the front lip.

13. A surface treating appliance including a floor tool as claimed in claim 1.

14. A surface treating appliance as claimed in claim 13 in the form of a cyclonic vacuum cleaner.

15. A floor tool for a surface treating appliance comprising, a sole plate comprising a floor engaging surface having a forward floor contacting edge and a rearward floor contacting edge and a suction opening, a head which is pivotable relative to the sole plate about an articulation axis between forward and rearward positions, the head comprising a barrel-shaped body which houses a brush bar which is rotatable about the articulation axis, the head further including a front sole plate engaging edge, a back sole plate engaging edge, and a connecting arm comprising an outlet in communication with the suction opening, wherein at least a portion of the rear floor contacting edge of the sole plate extends beyond the back sole plate engaging edge of the head when the head is in the rearward position.

16. A floor tool according to claim 15, comprising a single portion which extends beyond the back sole plate engaging edge of the head at a location spaced from side edges of the sole plate.

17. A floor tool according to claim 15, wherein the sole plate further comprises a rear lip which extends from at least a part of the rearward floor contacting edge of the sole plate.

18. A floor tool according to claim 17, wherein at least a part of the rear lip is associated with the portion which extends beyond the back sole plate engaging edge of the head to form a loop.

19. A floor tool according to claim 17, wherein at least a part of the rear lip is associated with the portion which extends beyond the back sole plate engaging edge of the head to form a loop.

20. A floor tool according to claim 15, wherein the portion extends from 50 mm to 55 mm from the articulation axis.

21. A floor tool according to claim 15, wherein the portion extends from 50 mm to 55 mm from the articulation axis.

22. A floor tool for a surface treating appliance, including a sole plate comprising a floor engaging surface having a forward floor contacting edge and a rearward floor contacting edge and a suction opening, a head which is pivotable relative to the sole plate about an articulation axis between forward and rearward positions, the head having a front sole plate engaging edge and a back sole plate engaging edge, and a connecting arm comprising an outlet in communication with the suction opening, wherein a portion of the rear floor contacting edge of the sole plate extends beyond the back sole plate engaging edge of the head when the head is in the rearward position, wherein the portion which extends beyond the back sole plate engaging edge of the head is at a location spaced from side edges of the sole plate and extends from the rearward floor contacting edge in a direction rearwards from the articulation axis in the same plane as the floor engaging surface of the sole plate.

23. A floor tool according to claim 22, wherein the sole plate further comprises a rear lip which extends from at least a part of the rearward floor contacting edge of the sole plate.

* * * * *